US008766748B2

(12) United States Patent
Mina et al.

(10) Patent No.: US 8,766,748 B2
(45) Date of Patent: Jul. 1, 2014

(54) MICROSTRIP LINE STRUCTURES WITH ALTERNATING WIDE AND NARROW PORTIONS HAVING DIFFERENT THICKNESSES RELATIVE TO GROUND, METHOD OF MANUFACTURE AND DESIGN STRUCTURES

(75) Inventors: Essam Mina, South Burlington, VT (US); Guoan Wang, South Burlington, VT (US); Wayne H. Woods, Jr., Burlington, VT (US)

(73) Assignee: International Business Machines Corporation, Armonk, NY (US)

( * ) Notice: Subject to any disclaimer, the term of this patent is extended or adjusted under 35 U.S.C. 154(b) by 721 days.

(21) Appl. No.: 12/960,009

(22) Filed: Dec. 3, 2010

(65) Prior Publication Data

US 2012/0139668 A1 Jun. 7, 2012

(51) Int. Cl.
*H01P 3/08* (2006.01)
*H01P 9/00* (2006.01)

(52) U.S. Cl.
CPC . *H01P 3/081* (2013.01); *H01P 9/00* (2013.01)
USPC ..... 333/238; 333/161; 333/34

(58) Field of Classification Search
CPC ..... H01P 3/081; H01P 9/00
USPC ..... 333/1, 4, 5, 34, 161, 204, 238
See application file for complete search history.

(56) References Cited

U.S. PATENT DOCUMENTS 3,879,690 A * 4/1975 Golant et al. ..... 333/204
5,150,436 A 9/1992 Jaeger et al.
5,291,162 A 3/1994 Ito et al.
5,459,633 A 10/1995 Kosslowski et al.
5,869,429 A 2/1999 Das
5,952,901 A 9/1999 Nakano
6,023,209 A 2/2000 Faulkner et al.
6,472,960 B1 * 10/2002 Ishikawa et al. ..... 333/204
6,650,192 B2 11/2003 Hayashi
6,794,947 B2 9/2004 Lin
6,819,204 B2 * 11/2004 Grunewald ..... 333/204
7,245,195 B2 * 7/2007 Satoh et al. ..... 333/204
8,193,880 B2 * 6/2012 Cho et al. ..... 333/238
2005/0093737 A1 5/2005 Schoebel (Continued)

FOREIGN PATENT DOCUMENTS

WO WO 8302687 8/1983

OTHER PUBLICATIONS

Sun et al., "A Compact Branch-Line Coupler Using Discontinuous Microstrip Lines", IEEE Microwave and Wireless Components Letters, vol. 15, No. 8, Aug. 2005, pp. 519-520.

(Continued)

*Primary Examiner* — Benny Lee
(74) *Attorney, Agent, or Firm* — Anthony Canale; Roberts Mlotkowski Safran & Cole, P.C.

(57) ABSTRACT

On-chip high performance slow-wave microstrip line structures, methods of manufacture and design structures for integrated circuits are provided herein. The structure includes at least one ground and a signal layer provided in a different plane than the at least one ground. The signal layer has at least one alternating wide portion and narrow portion with an alternating thickness such that a height of the wide portion is different than a height of the narrow portion with respect to the at least one ground.

16 Claims, 6 Drawing Sheets

(56) References Cited

U.S. PATENT DOCUMENTS

| | | | |
|---|---|---|---|
| 2006/0044073 | A1 | 3/2006 | Stoneham |
| 2006/0158286 | A1 | 7/2006 | Lai et al. |
| 2008/0048799 | A1 | 2/2008 | Wang et al. |

OTHER PUBLICATIONS

Seki et al., "Cross-Tie Slow-Wave Coplanar Waveguide on Semi-Insulating GaAs Substrates", Electronic Letters, vol. 17, No. 25, Dec. 10, 1981, pp. 940-941.

Wang et. al., "Novel Low-Cost On-Chip CPW Slow-Wave Structure for . . . Applications", Electronic Components and Technology Conference, 2008, pp. 186-190.

Ma et al., "Experimentally Investigating . . . Periodic Cells", IEEE, 2005, (4 pages).

Cheung et al., "Shielded Passive Devices . . . Circuits", IEEE Journal of Solid-State Circuits, vol. 41, No. 5, May 2006, pp. 1183-1200.

Wu et al., "Hybrid-Mode Analysis of . . . Lines", IEEE Transactions on Microwave Theory and Tech., vol. 39, No. 8, Aug. 1991, pp. 1348-1360.

Tilmans et al., "MEMS for wireless communications . . . RF-MEMS-SiP", J. Micromech. Microeng. 13 (2003), pp. S139-S163.

Ponchak, "RF Transmission Lines on Silicon Substrates", 29th European Microwave Conf. Digest, Oct. 1999, (4 pages).

Sakagami et al., "A Reduced Branch-Line Coupler with Eight Stubs", 1997 Asia Pacific Microwave Conf., pp. 1137-1140.

Sor et al., "A Novel Low-Loss . . . Filter Applications", IEEE, 2001, 4 pages.

Martin et al., "Dual Electromagnetic Bandgap CPW Structures for Filter Applications", IEEE Microwave and Wireless Components Letters, vol. 13, No. 9, Sep. 2003, pp. 393-395.

Application and drawings for U.S. Appl. No. 12/752,554, filed Apr. 1, 2010.

* cited by examiner

MICROSTRIP LINE STRUCTURES WITH ALTERNATING WIDE AND NARROW PORTIONS HAVING DIFFERENT THICKNESSES RELATIVE TO GROUND, METHOD OF MANUFACTURE AND DESIGN STRUCTURES

FIELD OF THE INVENTION

The invention generally relates to microstrip line structures and, in particular, to on-chip high performance slow-wave microstrip line structures, methods of manufacture and design structures for integrated circuits.

BACKGROUND

To meet the requirements of the future hand-held and ground communications systems as well as communications satellites, increasing the level of integration in the size and component count is needed. In circuit design, passive components refer to components that are not capable of power gain such as, for example, capacitors, inductors, resistors, diodes, transmission lines and transformers. In circuit design for communications systems, for example, a large area of the board is taken up by passive devices. For example, 90-95% of components in a cellular telephone are passive components, taking up approximately 80% of the total transceiver board, which accounts for about 70% of the cost. To reduce the space taken up by the passive devices, very small discrete passive components and the integration of the passive components are under required.

Multi-chip module, system on chip (SOC)/system on package (SOP) in which the passive devices and interconnects are incorporated into the carrier substrate offer an attractive solution to further increase the integration. For example, SOC is a fully integrated design with RF passive devices and digital and analog circuits on the same chip. Their operation on CMOS grade silicon, however, is degraded by the high loss of transmission lines and antennas. On the other hand, BiCMOS technologies present a cost effective option to realize highly integrated systems combining analog, microwave design techniques, transmission lines and other passive components.

In any event, many efforts have been made to reduce the size of the passive devices. For example, to reduce the space taken up by the passive components, discrete passive components have been replaced with on-chip passive components. However, size reduction of passive components may depend at least in part on the further development of on-chip interconnects, such as slow-wave microstrip line (SWML) structures, for microwave and millimeter microwave integrated circuits (MICs), microwave and millimeter monolithic microwave integrated circuits (MMICs), and radiofrequency integrated circuits (RFICs) used in communications systems. In particular, interconnects that promote slow-wave propagation can be employed to reduce the sizes and cost of distributed elements to implement delay lines, variable phase shifters, branchline couplers, voltage-tunable filters, etc. However, advanced microstrip line structures are needed for radiofrequency and microwave integrated circuits to serve as interconnects that promote slow-wave propagation, as well as related design structures for radio frequency and microwave integrated circuits.

Accordingly, there exists a need in the art to overcome the deficiencies and limitations described hereinabove.

SUMMARY

In a first aspect of the invention, a structure comprises at least one ground and a signal layer provided in a different plane than the at least one ground. The signal layer has at least one alternating wide portion and narrow portion with an alternating thickness such that a height of the wide portion is different than a height of the narrow portion with respect to the at least one ground.

In an another aspect of the invention, a slow wave microstrip line (SWML) structure comprises a signal layer having portions with alternating different thicknesses T1, T2 and heights H1, H2, from a ground line provided below the signal layer. The ground line has a uniform thickness.

In yet another aspect of the invention, a method of tuning a microstrip line structure comprises tuning at least one of a capacitance and inductance of the microstrip line structure by adjusting at least one of a thickness and spacing of at least one of a wide portion and a narrow portion of a signal layer. The signal layer is at a different plane than ground.

In another aspect of the invention, a design structure tangibly embodied in a machine readable storage medium for designing, manufacturing, or testing an integrated circuit is provided. The design structure comprises the structures of the present invention. In further embodiments, a hardware description language (HDL) design structure encoded on a machine-readable data storage medium comprises elements that when processed in a computer-aided design system generates a machine-executable representation of the slow-wave microstrip line (SWML), which comprises the structures of the present invention. In still further embodiments, a method in a computer-aided design system is provided for generating a functional design model of the SWML. The method comprises generating a functional representation of the structural elements of the SWML.

BRIEF DESCRIPTION OF THE SEVERAL VIEWS OF THE DRAWINGS

The present invention is described in the detailed description, which follows, in reference to the noted plurality of drawings by way of non-limiting examples of exemplary embodiments of the present invention.

DETAILED DESCRIPTION

Figure 1:
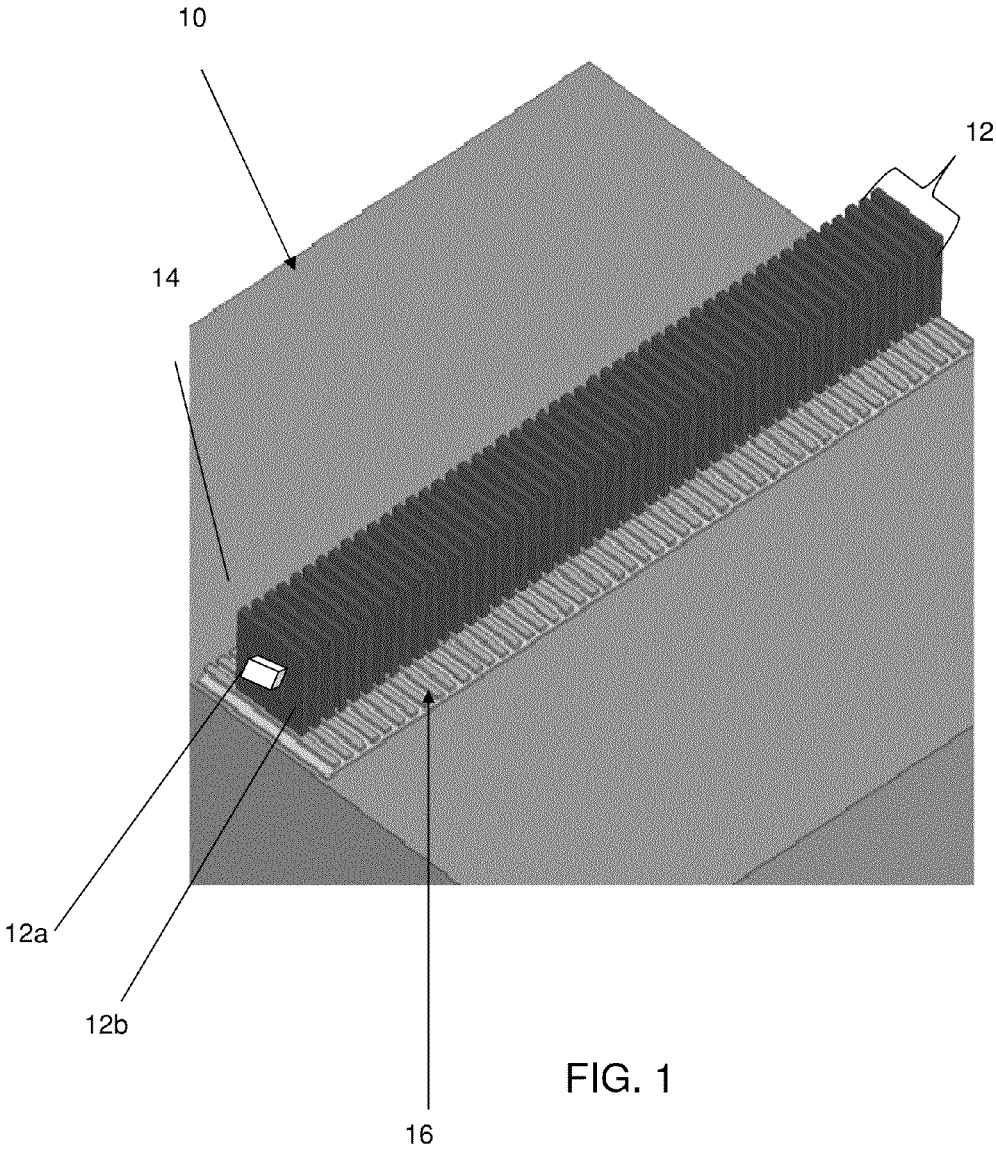
FIG. 1 shows a slow-wave microstrip line structure in accordance with aspects of the invention.

The invention generally relates to line structures and, in particular, to on-chip high performance slow-wave microstrip line (SWML) structures, methods of manufacture and design structures for integrated circuits. In embodiments, the present invention provides a compact on-chip SWML structure that has more design flexibility to achieve improved slow-wave effects, compared to conventional structures. For example, the present invention reduces the space taken up by passive devices such as, e.g., used for the miniaturization of microwave integrated circuits (MICs) and Monolithic microwave integrated circuits (MMICs). More specifically, the microstrip line circuit components of the present invention can be used to dramatically reduced the size of a branchline coupler having several quarter wavelength arms.

In embodiments, the present invention provides ideal on-chip SWML structures with low losses and improved characteristic impedance, while utilizing considerably less board area than conventional systems. In embodiments, the SWML structures of the present invention include a signal layer comprising a plurality of cells, where each cell has a narrow (W1) portion and a wide (W2) portion, in an alternating arrangement. In embodiments, the SWML structures also include, for example, different dimension wires, T1, T2 (e.g., thinner and thicker dimensions) for the signal layer. In embodiments, the signal layer can have a constant width, with different thicknesses, T1, T2. In embodiments, the spacing H1, H2 between the ground and different portions of the signal layer can be adjusted for different inductance and/or capacitance values. The SWML structures can also include a cross-under metal (conductive) layer, which may connect with ground through the use of vias, where the cross-under metal layer is under the wide portion of the signal layer.

In embodiments, the SWML structures can be adjusted by using different W1, W2, T1, T2, H1, H2 values and W1/W2 and/or T1/T2 and/or H1/H2 ratios, different separations, pitch, and/or adding floating strips above and/or below the SWML structures. That is, the slow-wave effect of the SWML structures can be tuned by, for example, (i) changing the pitch of each cell;

(ii) changing the width difference ratio of the signal layer;

(iii) changing the thicknesses of the signal layer at different regions which results in a change of the separation between the signal layer and ground; and/or (iv) adding cross-under metal strips.

Accordingly, and advantageously, the SWML structures can be implemented for any characteristic impedance.

More specifically, the SWML structures of the present invention include a three dimensional structure in the signal layer. The SWML structures, for example, are made by placing a wide (W2), short and thick (T2) line and a narrow (W1), short and thin (T1) line, in alternating fashion. In embodiments, the signal layer may include, for example, placing a thick (T2) line and thin (T1) line, in alternating fashion, with a constant width dimension. The slow wave effect can be changed by using different W1, W2, T1, T2 values and ratios, different separations, pitch, and/or adding floating strips above and below the SWML structure. The SWML structure of the present invention can be implemented for any characteristic impedance.

By way of background, from the transmission line theory, the wavelength λ, a phase velocity "v" and characteristics impedance Zo are given respectively as:

$$\lambda = \frac{v}{f} \tag{1}$$

$$v \propto \frac{1}{\sqrt{LC}} \tag{2}$$

$$Zo = (L/C)^{1/2} \tag{3}$$

where f is the wave's frequency, L and C are the inductance and capacitance per unit length, respectively, v is the magnitude of phase velocity and λ is the wavelength.

From the above equations, the wavelength can be made smaller while the characteristic impendence is kept unchanged by increasing L and C with the same ratio. Also, increasing either or both the inductance L and/or capacitance C will decrease the velocity v and hence the wavelength λ. And, decreasing the wavelength λ will physically reduce the dimension of passive components such as branchline coupler which includes four quarter wavelength arms, thereby reducing the chip space needed for the SWML structure and components built with them.

FIG. 1 shows a slow-wave microstrip line structure in accordance with aspects of the invention. More specifically, FIG. 1 shows a slow-wave microstrip line (SWML) structure 10 having a signal layer 12 with alternating narrow portions 12*a* and wide portions 12*b*. The signal layer 12 is formed in a different plane than at least one ground 14. In embodiments, the at least one ground 14 can be provided underneath the signal layer 12; although the ground 14 can be formed over the signal layer 12 or both below and above the signal layer 12. Hereinafter, the present invention will be described using a single ground formed under the signal layer 12. An optional cross-under metal structure 16 can be formed under the signal layer 12, and preferably between wide portions of the signal layer 12 and the ground 14. The cross-under metal structure 16 can be used to increase capacitance of the structure.

The signal layer 12 and ground 14 (and optional cross-under structure 16) can be formed using conventional lithographic, etching and deposition processes, commonly employed in CMOS fabrication. For example, a resist can be placed over an insulating layer and exposed to light to form patterns, corresponding with the shapes of the signal layer 12 under a ground plate 14. The exposed regions of the insulating layer are then etched to form trenches using conventional processes such as, for example, reactive ion etching. A metal or metal alloy layer is then deposited in the trenches to form the signal layer 12 over a metal ground 14. The signal layer 12 and ground 14 can be formed of any known metal or metal alloy, suitable for its particular purpose. The optional cross-under structure 16 can be formed in a similar manner using CMOS fabrication processes, prior to the formation of the signal layer 12. The optional cross-under structure 16 will align with the wide portions 12*b* of the signal line 12.

Figure 2:
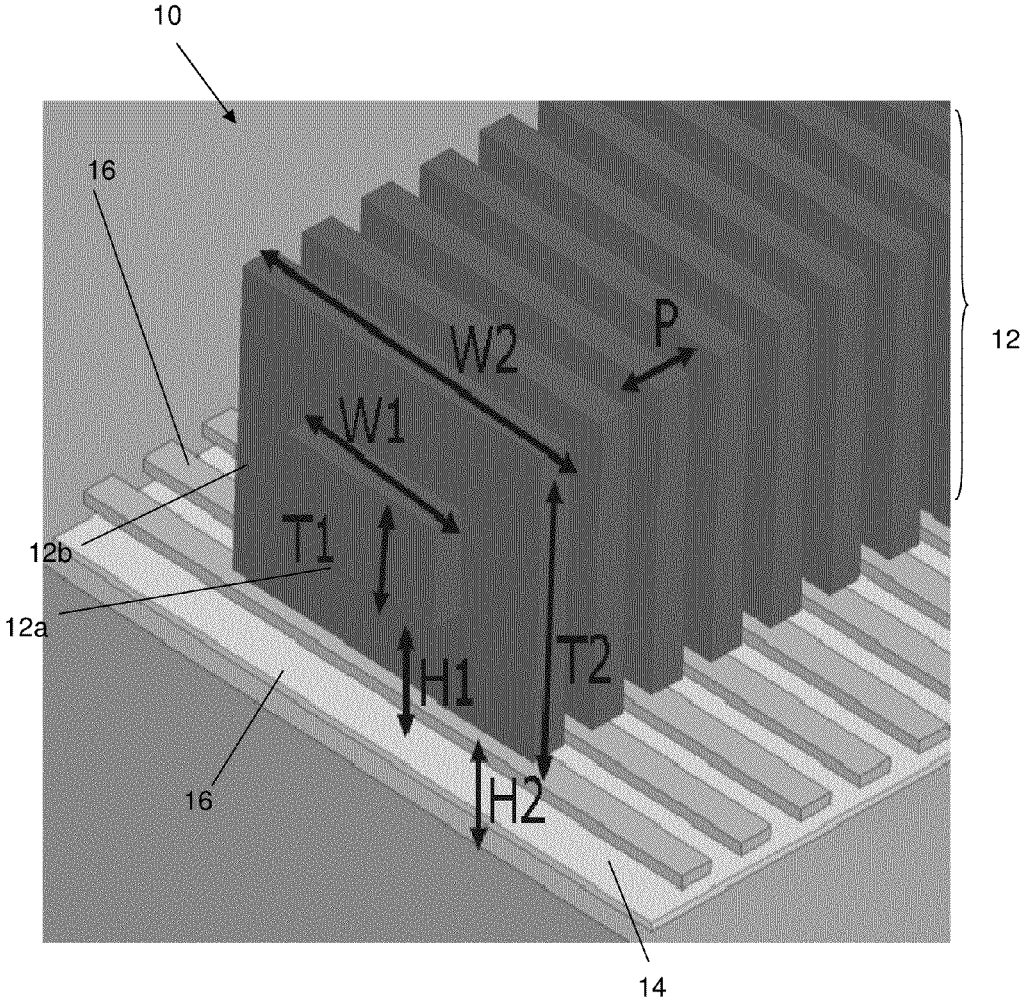
FIG. 2 shows an exploded view of a slow-wave microstrip line structure of FIG. 1, in accordance with additional aspects of the invention.

FIG. 2 shows an exploded view of the SWML structure 10 of FIG. 1 in accordance with aspects of the invention. FIG. 2 more specifically shows the dimensions W1, W2 and T1, T2 of the alternating narrow portions 12*a* and wide portions 12*b* of the signal layer 12, as well as the spacing H1, H2 between the narrow portions 12*a* and wide portions 12*b* and ground 14, respectively. FIG. 2 also shows the ground 14 with a uniform width.

More specifically, the narrow portions 12*a* have a width W1 and the wide portions 12*b* have a width W2, where W2>W1. The widths of the narrow portions 12*a* and the wide portions 12*b* can vary such as, for example, between about 0.25 microns to 100 microns. Also, the narrow portions 12*a* have a thickness T1 and the wide portions 12*b* have a thickness T2, where T2>T1. The thickness of the narrow portions 12*a* and the wide portions 12*b* can vary such as, for example, between about 10 nm to 20 microns. In embodiments, the thickness of T1 can be about 2 to 20 times smaller than T2, for example.

The spacing (separation) between the narrow portion 12*a* and the ground 14 is represented by H1; whereas, the spacing (separation) between the wide portion 12*b* and the ground 14 is represented by H2. In embodiments, H1>H2, with the spacing of H1 and H2 being capable of varying depending on the thicknesses T1 and T2 of the alternating narrow portions 12*a* and wide portions 12*b*. For example, as the thickness T1 becomes smaller, spacing H1 becomes larger (See, e.g., FIG. 3).

FIG. 2 also shows a pitch "P" comprising a narrow portion 12*a* and wide portion 12*b*. In embodiments, the pitch "P" can vary from, for example, about 1 micron to about 50 microns. That is, one narrow portion 12*a* and one wide portion 12*b* may have a spacing of about 1 micron; whereas, one narrow portion 12*a* and one wide portion 12*b* can also have a spacing of about 50 microns. Varying the pitch P can be used to tune the structure 10. For example, a small pitch will increase both capacitance C and inductance L, as well as increase the slow-wave effect.

Inductance and capacitance of the SWML structure 10 can be tuned by varying the thicknesses T1 and T2 and, hence, the spacing H1, H2 between the signal layer 12 and the ground 14. Capacitance and inductance can also be adjusted by varying the width dimensions W1, W2. In an illustrative example, inductance L of the SWML structure 10 may be decided by the smaller thickness T1 and the larger spacing H1 (and smaller width W1); whereas, capacitance C of the SWML structure is decided by the larger thickness T2 and the smaller spacing H2 (and larger width W2). More specifically, a larger inductance L can be achieved as thickness T1 becomes smaller and spacing H1 becomes larger. Likewise, a larger capacitance C can be achieved as thickness T2 becomes larger and H2 becomes smaller. Thus, by changing the values of W1, W2, H1 and H2, as well as T1, T2, different L and C values can be achieved, resulting in different characteristic impedance and changing or tuning the slow-wave effect. Cross-under 16 strips can also be used to improve the slow-wave effect, e.g., increase capacitance, placed under the wider portions 12*b*.

In other words, from the above equations, the wavelength can be made smaller while the characteristic impedance is kept unchanged by increasing L and C with the same ratio. That is, when the pitch "P" is very small compared with the wavelength, L is mainly determined by the thickness T1 and larger spacing H1 between signal layer 12 and ground 14, while capacitance C is determined by the thicker metal line T2 and the smaller spacing H2 between signal layer 12 and ground 14. Accordingly, as shown in FIG. 2, thickness T1 is small and the spacing H1 is large, so larger inductance L can be achieved. Also, the thickness T2 is large and spacing H2 is small, so a larger capacitance C can be achieved. Thus, by changing the values of W1, W2, H1, H2, T1 and T2, different inductance L and capacitance C values can be achieved and so will the different characteristics impedance, thereby making it possible to change the slow wave effect.

Accordingly, in view of the above, those of ordinary skill in the art, should understand that the SWML structures of the present invention provide the following advantageous relationships:

- H1, W1 and T1 are related to inductance. By increasing H1, decreasing W1 and/or decreasing T1, the inductance will become larger;
- H2, W2 and T2 are related to capacitance. By decreasing H2, increasing W2 and/or increasing T2, the capacitance will become larger; and
- The metal lines (cross under structure) will increase capacitance (because H2 will be decreased).

Figure 3:
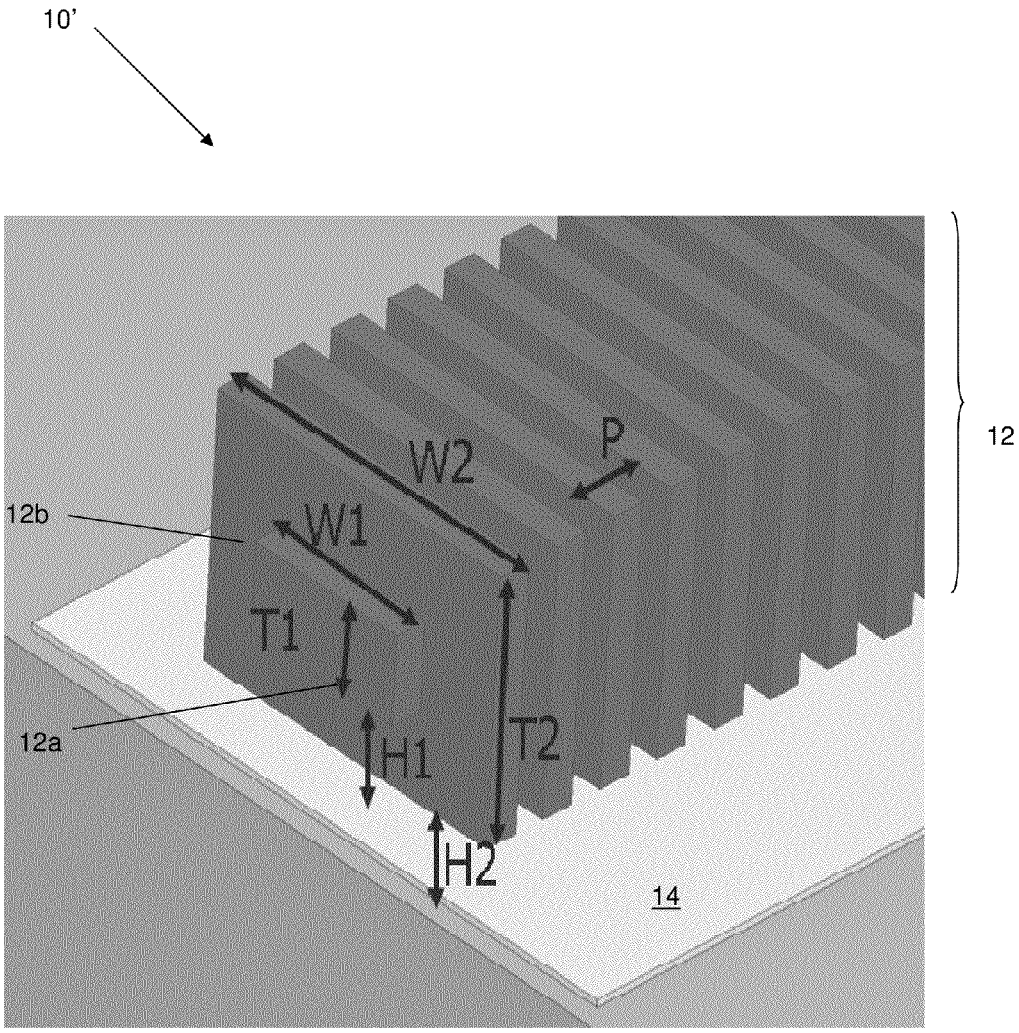
FIG. 3 shows a slow-wave microstrip line structure in accordance with additional aspects of the invention.

FIG. 3 shows a slow-wave microstrip line (SWML) structure in accordance with aspects of the invention. In the SWML structure 10', the signal layer 12, including the narrow portions 12*a* and the wide portions 12*b* is placed over the ground 14, without any intervening metal lines (cross-under structure). More specifically, in this embodiment, the ground 14 is directly under signal layer 12. FIG. 3 further shows the dimensions T1, T2, W1, W2, H1, H2 and P as described herein.

Figure 4:
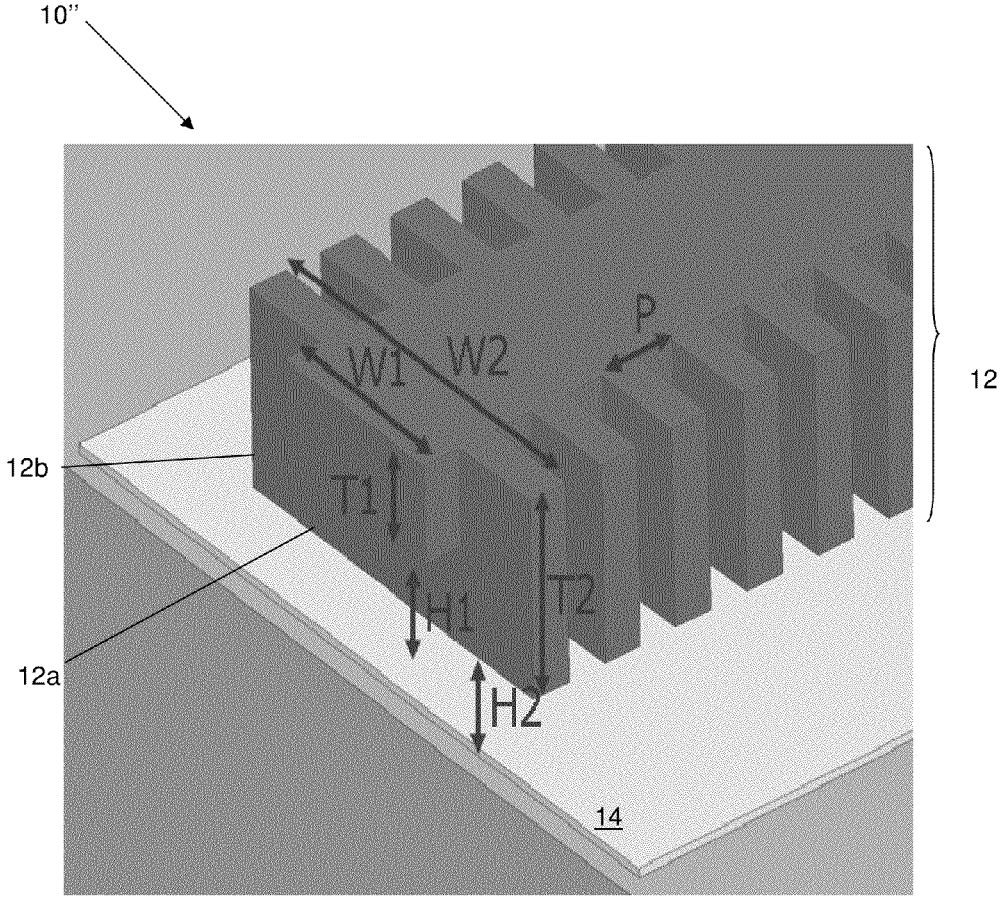
FIG. 4 shows a slow-wave microstrip line structure in accordance with additional aspects of the invention.

FIG. 4 shows a slow-wave microstrip line (SWML) structure in accordance with aspects of the invention. In this structure, the SWML structure 10" is a variant of the SWML structure 10' shown in FIG. 3. For example, in this embodiment, the narrow portion 12*a* (e.g., thinner portion T1) is provided (or formed) at a top portion of the wide portion 12*b* (measured between a top surface and a bottom surface), to form a planar, top surface. This is accomplished by adjusting the thickness T2 of the wide portion 12*b*. In alternative embodiments, this can be accomplished by moving the narrow portion 12*a* to a top portion of the wide portion 12*b*, with different capacitance/inductance effects. For example, in the embodiment shown in FIG. 4, the inductance of the structure can be increased, by decreasing the parameter T1. Alternatively, the capacitance of the structure can be increased by maintaining the thickness T1, but moving the narrow portion 12*a* to the top portion of the wide portion 12*b*, e.g., increasing the parameter H1. FIG. 4 also shows the dimensions H2, W1, W2 and P as described herein.

It should be understood as with all of the embodiments of the present invention, the height H1 of the narrow portions 12*a* can be adjusted by placing the narrow portions 12*a* at different positions with respect to the wider portions 12*b*. As such, it should be understood by those of skill in the art that the height H1 can vary based on adjustments to T1 and/or the position of the narrow portions 12*a*. It should also be understood that any of the SWML structures thus shown and described can be bended or folded to build meandering lines in this way, for further increase in the slow wave effect, a deflected ground structure (or signal layer) can be used to obtain larger separation between the ground 14 and signal layer 12. This can dramatically increase the inductance L and, likewise, increase the slow wave effect.

Figure 5:
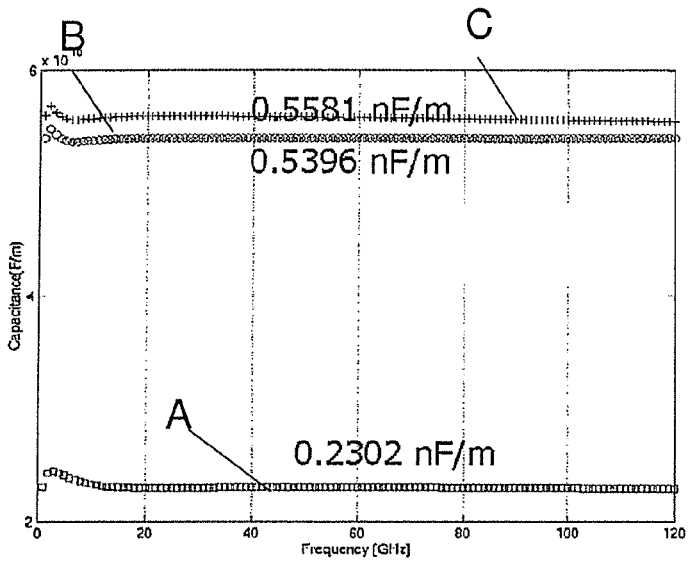
FIGS. 5 and 6 show various comparison performance graphs of structures in accordance with aspects of the invention.

FIG. 5 shows a comparison graph of capacitance (F/m) vs. frequency (GHz) for the SWML structures described above vs. a conventional microstrip structure. In the example of FIG. 5, line "A" (0.2302 n/Fm) represents a conventional structure (H1=H2 and T1=T2), line "B" (0.5396 n/Fm) represents the structure of FIG. 4 and line "C" (0.5581 n/Fm) represents the structure of FIG. 3. In the graph of FIG. 5, the signal layer has a width W1 of 10 microns, width W2 of 20 microns and a pitch of 4 microns.

As shown in this representative graph of FIG. 5, the SWML structure represented by line "A" shows the lowest capacitance. On the other hand, the SWML structure represented by line "C" shows the highest capacitance, with the SWML structure represented by line "B" having a comparable capacitance to the structure represented by line "C." In these representative structures, the SWML structure represented by line "C" has a larger capacitance than the SWML structure represented by line "B", because the SWML structure represented by line "C" has a larger T1 dimension.

Figure 6:
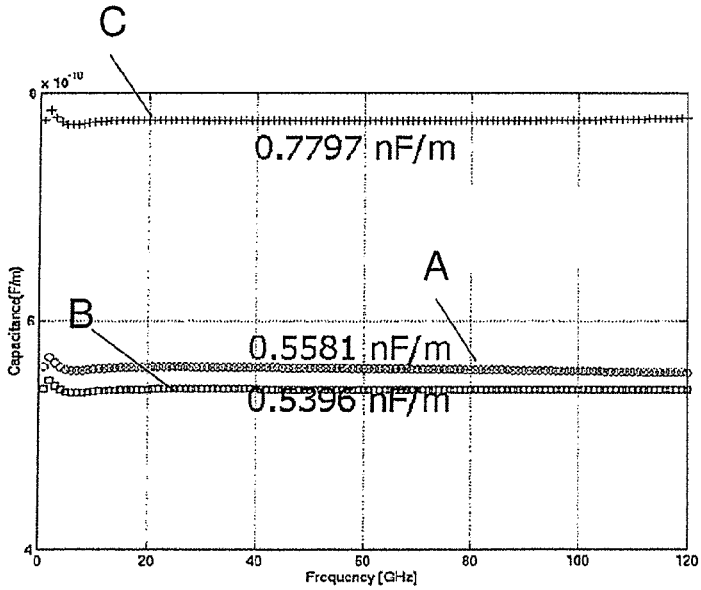

FIG. 6 shows a comparison of capacitance (F/m) vs. frequency (GHz) for the SWML structures described above. In the example of FIG. 6, line "A" (0.5581 n/Fm) represents the structure of FIG. 2, line "B" (0.5396 n/Fm) represents the structure of FIG. 3 and line "C" (0.7797 n/Fm) represents the structure of FIG. 4. In the graph of FIG. 6, the signal layer has width W1 of 10 microns, width W2 of 20 microns and a pitch of 4 microns. As shown in this representative graph, the SWML structure represented by line "A" shows the highest capacitance, the SWML structure represented by line "B" shows the second highest capacitance and the SWML structure represented by line "A" shows the lowest capacitance. Basically, the structure represented by line "A" includes a large T2 and an under-cross metal structure, which provides a larger capacitance than the structure represented by line "B"

with the same dimensions. This is due mainly to the inclusion of the under-cross metal structure, which effectively decreases parameter H1. The structure represented by line "B" has the lowest capacitance since it has the smallest T1 parameter.

Accordingly, it should be understood by those of skill in the art, after reading the present disclosure, that slow wave effect of the SWML structures of the present invention can be tuned by, for example:

- changing the pitch of each cell;
- changing the width difference ratio of the signal layer parameters;
- changing the thickness of the wide and narrow part of the signal layer resulting in a change in separation between the signal layer and ground (at either or both the narrow or wide signal layer and ground);
- changing the width of the signal layer; and/or
- adding the cross under metal strips.

As should now be understood by those of ordinary skill in the art, the structure 10 (or 10' or 10") comprises a discontinuous transmission line which is built with three dimensional steps, with floating metal strips crossing below the signal line (in some embodiments). The slow-wave structure of the present invention shows improved slow wave effect, with about 3.3 times of capacitance per unit length increase compared with the current slow-wave structures with a two dimensional step. In this way, the present invention can shrink the passive components size by about 60%.

Figure 7:
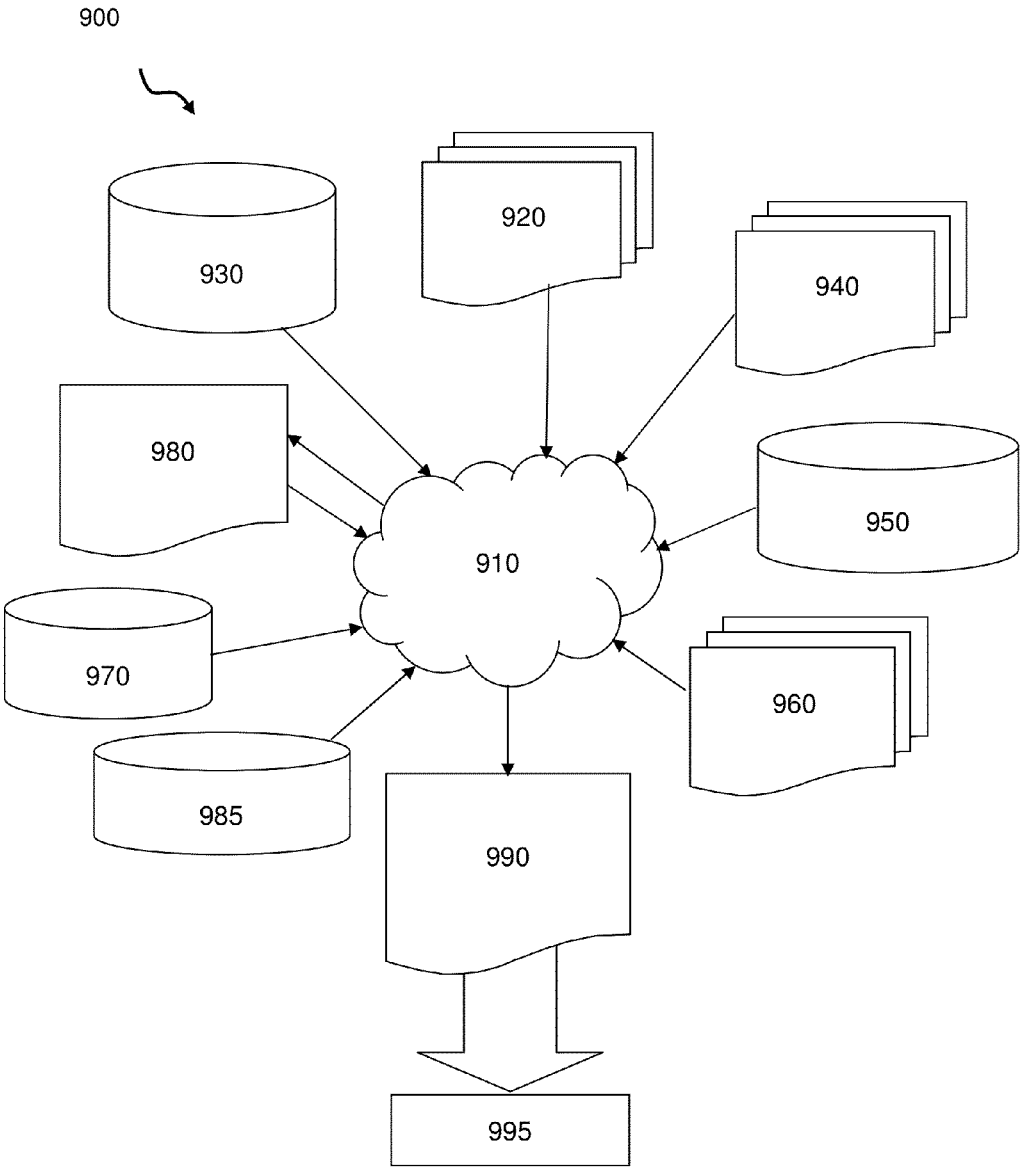
FIG. 7 is a flow diagram of a design process used in semiconductor design, manufacture, and/or test.

FIG. 7 is a flow diagram of a design process used in semiconductor design, manufacture, and/or test. FIG. 7 shows a block diagram of an exemplary design flow 900 used for example, in semiconductor IC logic design, simulation, test, layout, and manufacture. Design flow 900 includes processes, machines and/or mechanisms for processing design structures or devices to generate logically or otherwise functionally equivalent representations of the design structures and/or devices described above and shown in FIGS. 1-4. The design structures processed and/or generated by design flow 900 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 900 may vary depending on the type of representation being designed. For example, a design flow 900 for building an application specific IC (ASIC) may differ from a design flow 900 for designing a standard component or from a design flow 900 for instantiating the design into a programmable array, for example a programmable gate array (PGA) or a field programmable gate array (FPGA) offered by manufacturers such as Altera® Inc. or Xilinx® Inc.

FIG. 7 illustrates multiple such design structures including an input design structure 920 that is preferably processed by a design process 910. Design structure 920 may be a logical simulation design structure generated and processed by design process 910 to produce a logically equivalent functional representation of a hardware device. Design structure 920 may also or alternatively comprise data and/or program instructions that when processed by design process 910, generate a functional representation of the physical structure of a hardware device. Whether representing functional and/or structural design features, design structure 920 may be generated using electronic computer-aided design (ECAD) such as implemented by a core developer/designer. When encoded on a machine-readable data transmission, gate array, or storage medium, design structure 920 may be accessed and processed by one or more hardware and/or software modules within design process 910 to simulate or otherwise functionally represent an electronic component, circuit, electronic or logic module, apparatus, device, or system such as those shown in FIGS. 1-4. As such, design structure 920 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 910 preferably employs and incorporates hardware and/or software modules for synthesizing, translating, or otherwise processing a design/simulation functional equivalent of the components, circuits, devices, or logic structures shown in FIGS. 1-4 to generate a netlist 980 which may contain design structures such as design structure 920. Netlist 980 may comprise, for example, compiled or otherwise processed data structures representing a list of wires, discrete components, logic gates, control circuits, I/O devices, models, etc. that describes the connections to other elements and circuits in an integrated circuit design. Netlist 980 may be synthesized using an iterative process in which netlist 980 is resynthesized one or more times depending on design specifications and parameters for the device. As with other design structure types described herein, netlist 980 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 910 may include hardware and software modules for processing a variety of input data structure types including netlist 980. Such data structure types may reside, for example, within library elements 930 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 940, characterization data 950, verification data 960, design rules 970, and test data files 985 which may include input test patterns, output test results, and other testing information. Design process 910 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 910 without deviating from the scope and spirit of the invention. Design process 910 may also include modules for performing standard circuit design processes such as timing analysis, verification, design rule checking, place and route operations, etc.

Design process 910 employs and incorporates logic and physical design tools such as HDL compilers and simulation model build tools to process design structure 920 together with some or all of the depicted supporting data structures along with any additional mechanical design or data (if applicable), to generate a second design structure 990.

Design structure 990 resides on a storage medium or programmable gate array in a data format used for the exchange of data of mechanical devices and structures (e.g. information stored in a Initial Graphics Exchange Specification (IGES), DXF (Drawing Interchange Format), Parasolid XT, JT, DRG (DraWinG), or any other suitable format for storing or rendering such mechanical design structures). Similar to design structure 920, design structure 990 preferably comprises one or more files, data structures, or other computer-encoded data or instructions that reside on transmission or data storage media and that when processed by an ECAD (Electronic design automation) system generate a logically or otherwise functionally equivalent form of one or more of the embodiments of the invention shown in FIGS. 1-4. In one embodiment, design structure 990 may comprise a compiled, executable HDL (hardware description language) simulation model that functionally simulates the devices shown in FIGS. 1-4.

Design structure 990 may also employ a data format used for the exchange of layout data of integrated circuits and/or symbolic data format (e.g. information stored in a GDSII (Graphic Database System II) (GDS2), GL1 (Global Area 1), OASIS (Open Artwork System Interchange Standard), map files, or any other suitable format for storing such design data structures). Design structure 990 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1-4. Design structure 990 may then proceed to a stage 995 where, for example, design structure 990: proceeds to tape-out (e.g., final result of the design cycle), is released to manufacturing, is released to a mask house, is sent to another design house, is sent back to the customer, etc.

The method as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims, if applicable, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principals of the invention and the practical application, and to enable others of ordinary skill in the art to understand the invention for various embodiments with various modifications as are suited to the particular use contemplated. Accordingly, while the invention has been described in terms of embodiments, those of skill in the art will recognize that the invention can be practiced with modifications and in the spirit and scope of the appended claims.

What is claimed:

1. A structure, comprising:

at least one ground; and a signal layer provided in a different plane than the at least one ground, the signal layer having at least one alternating wide portion and narrow portion with an alternating thickness such that a height of the wide portion is different than a height of the narrow portion with respect to the at least one ground, wherein the narrow portion has a first thickness T1 and the wide portion has a second thickness T2, wherein T1<T2.

2. The structure of claim 1, wherein the narrow portion is provided at a top portion of the wide portion.

3. The structure of claim 1, wherein the narrow portion has a width W1 and the wide portion has a width W2, wherein W2>W1.

4. The structure of claim 1, further comprising a spacing H1 between the narrow portion and the at least one ground and a spacing H2 between the wide portion and the at least one ground, wherein H1>H2.

5. A structure, comprising:

at least one ground; and a signal layer provided in a different plane than the at least one ground, the signal layer having at least one alternating wide portion and narrow portion with an alternating thickness such that a height of the wide portion is different than a height of the narrow portion with respect to the at least one ground, wherein:

the narrow portion is provided at a top portion of the wide portion, and the narrow portion and the wide portion form a planar, top surface.

6. A slow wave microstrip line (SWML) structure, comprising a signal layer having portions with alternating different thicknesses T1, T2 and heights H1, H2, from a ground line provided below the signal layer, the ground line having a uniform thickness, wherein:

the signal layer has alternating widths that corresponding to the alternating different thicknesses T1, T2 and heights H1, H2, and the signal line further comprises alternating widths W1, W2, wherein:

a first portion of the signal line includes T1, H1 and W1;

a second portion of the signal line includes T2, H2 and W2;

T1<T2;

H1>H2; and

W1<W2.

7. A structure, comprising:

at least one ground;

a signal layer provided in a different plane than the at least one ground, the signal layer having at least one alternating wide portion and narrow portion with an alternating thickness such that a height of the wide portion is different than a height of the narrow portion with respect to the at least one ground; and cross-under conductive structure positioned under the signal layer and coupled to the at least one ground.

8. The structure of claim 7, wherein the cross-under conductive structure is provided between the signal line and the at least one ground.

9. The structure of claim 7, wherein the at least one alternating wide portion and narrow portion are a plurality of alternating wide portions and narrow portions, and the cross-under conductive structure includes conductive strips that align with the wide portions of the signal layer.

10. A design structure readable by a machine used in designing, manufacturing, or testing of an integrated circuit, the design structure comprising a functional representation of:

at least one ground;

a signal layer provided in a different plane than the at least one ground, the signal layer having at least one alternating wide portion and narrow portion with an alternating thickness such that a height of the wide portion is different than a height of the narrow portion with respect to the at least one ground; and a cross-under conductive structure positioned under the signal layer and coupled to the at least one ground.

11. The design structure of claim 10, wherein the design structure comprises a netlist.

12. The design structure of claim 10, wherein the design structure resides in a storage medium as a data format used for the exchange of layout data of integrated circuits.

13. The design structure of claim 10, wherein the design structure resides in a programmable gate array.

14. A method of tuning a microstrip line structure, comprising tuning at least one of a capacitance and inductance of the microstrip line structure by adjusting at least one of a thickness of at least one of a wide portion and a narrow portion of a signal layer that is at a different plane than a ground and a spacing between at least one of the wide portion and the narrow portion of the signal layer and the ground, and providing at least one of a conductive wiring underneath the signal layer to increase capacitance.

15. The method of claim 14, further comprising adjusting a width of at least one of the wide portion and the narrow portion.

16. The method of claim 14, further comprising adjusting a pitch of the wide portion and a narrow portion of the signal layer.

* * * * *